US006148919A

United States Patent [19]

Burris, II et al.

[11] Patent Number: 6,148,919

[45] Date of Patent: Nov. 21, 2000

[54] APPARATUS HAVING A RELEASABLE LOCK

[75] Inventors: Wesley J. Burris, II, Flower Mound; Neal G. Skinner, Lewisville, both of Tex.

[73] Assignee: Halliburton Energy Services, Inc., Dallas, Tex.

[21] Appl. No.: 09/065,940

[22] Filed: Apr. 24, 1998

[51] Int. Cl.[7] ..... E21B 34/10

[52] U.S. Cl. ..... 166/319; 166/321

[58] Field of Search ..... 166/319, 72, 125, 166/208, 212, 332.1, 321

[56] References Cited

U.S. PATENT DOCUMENTS

| | | | |
|---|---|---|---|
| 3,554,305 | 1/1971 | Kammerer, Jr. | 175/268 |
| 3,845,815 | 11/1974 | Garwood | 166/154 |
| 3,882,935 | 5/1975 | Calhoun | 166/322 |
| 4,067,062 | 1/1978 | Baugh | 166/374 |
| 4,576,234 | 3/1986 | Upchurch | 166/319 |
| 4,597,439 | 7/1986 | Meek | 166/163 |
| 4,633,952 | 1/1987 | Ringgenberg . | |
| 5,341,883 | 8/1994 | Ringgenberg . | |
| 5,518,073 | 5/1996 | Manke et al. | 166/240 |

*Primary Examiner*—Frank Tsay
*Attorney, Agent, or Firm*—Paul I. Herman; Marlin R. Smith

[57] ABSTRACT

Apparatus including a releasable lock is provided. In a described embodiment, a valve assembly includes a ball valve, a piston, and a releasable lock. The releasable lock prevents operation of the ball valve until a predetermined fluid pressure is applied to the exterior of the apparatus.

20 Claims, 11 Drawing Sheets

APPARATUS HAVING A RELEASABLE LOCK

BACKGROUND OF THE INVENTION

The present invention relates generally to equipment utilized in subterranean wells and, in an embodiment described herein, more particularly provides an apparatus having a releasable lock incorporated therein.

In many situations encountered while servicing a subterranean well, it may be desirable to delay or prevent actuation of a device until a desired condition is achieved. For example, a ball valve or other type of valve may be positioned in the well for controlling fluid flow through a tubular string in which the ball valve is interconnected. Operation of the ball valve to an open or closed position may not be desired until a predetermined fluid pressure is applied to the tubing string or an annulus between the tubing string and a wellbore of the well, a predetermined differential pressure is applied between the tubing string and the annulus, etc.

In these situations, a releasable lock is sometimes used to prevent operation of the device until the desired condition is achieved. The releasable lock is interconnected between a force generating assembly (a portion of an apparatus which generates a force to operate the device when the desired condition is achieved) and the device. When the desired condition is achieved, the releasable lock transmits the force to the device in such a manner that the device is operated, but otherwise resists such transmission of the force to the device. Thus, the releasable lock is a force transmitting assembly, which selectively permits application of the force to the device to operate the device.

In the past, hydraulic chambers and shear members, such as shear pins, have been used to construct releasable locks. When a hydraulic chamber is used, fluid is displaced from the hydraulic chamber in response to the desired condition being achieved. When shear members are used, the members are made to shear when a predetermined force is applied thereto.

Unfortunately, releasable locks using either of these elements suffer from some drawbacks. Shear members are susceptible to fatigue failure where a force is repeatedly applied to them, such as when pressure fluctuations are experienced while running into the well. Hydraulic chambers require a degree of precision in filling the chambers with appropriate types and volumes of fluid, are time-consuming and maintenance intensive, etc.

Therefore, what is needed is a releasable lock which is convenient in its assembly, use and maintenance, and which permits accurate operation of a device in a well, regardless of pressure fluctuations experienced while running into the well. It is accordingly an object of the present invention to provide such a releasable lock and apparatus incorporating the releasable lock therein.

SUMMARY OF THE INVENTION

In carrying out the principles of the present invention, in accordance with an embodiment thereof, apparatus is provided which includes a releasable lock. The releasable lock accurately prevents operation of a device of the apparatus until a desired condition is achieved. When the condition is achieved, the releasable lock permits transmission of force to the device to operate the device.

In one aspect of the present invention, an apparatus is provided which includes a force generating assembly, a force transmitting assembly and a device. The force transmitting assembly is interconnected between the force generating assembly and the device. A force is transmitted to the device in a manner so that the device is operated, when a desired condition is achieved.

In another aspect of the present invention, the force transmitting assembly includes first, second and third members. The third member is selectively positionable to permit or prevent displacement of the first member relative to the second member. The first member is engaged by the force generating assembly, and the second member is engaged by the device. The device is operated when the first member displaces relative to the second member.

In yet another aspect of the present invention, the apparatus is a valve assembly including a ball valve, and the force generating assembly comprises a piston having a differential piston area thereon exposed to fluid pressure external to the valve assembly. The force transmitting assembly transmits force from the piston to the ball valve to operate the ball valve when fluid pressure external to the valve assembly reaches a predetermined pressure.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

Figure 1A:
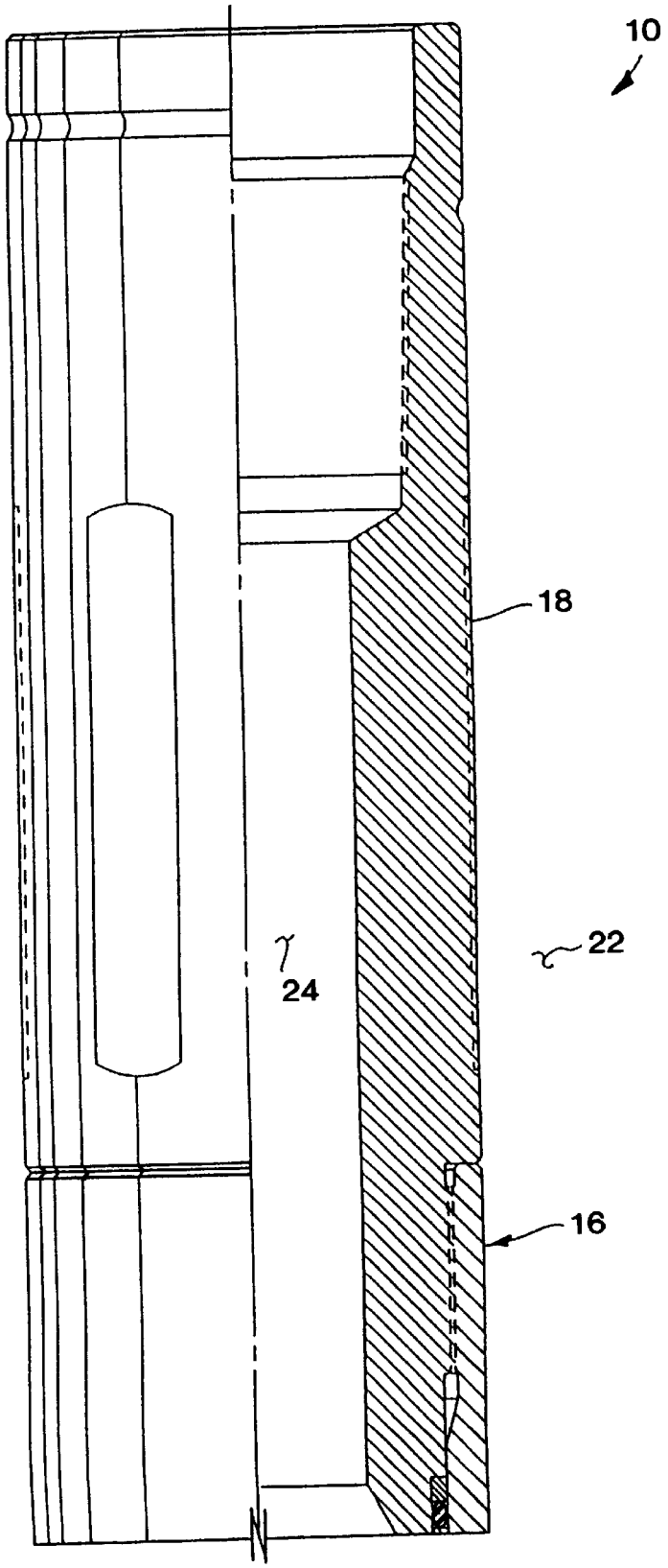
FIGS. 1A–I are partially elevational and partially cross-sectional views of a valve assembly embodying principles of the present invention, the valve being shown in a configuration in which it is run into a subterranean well.
Figure 1B:
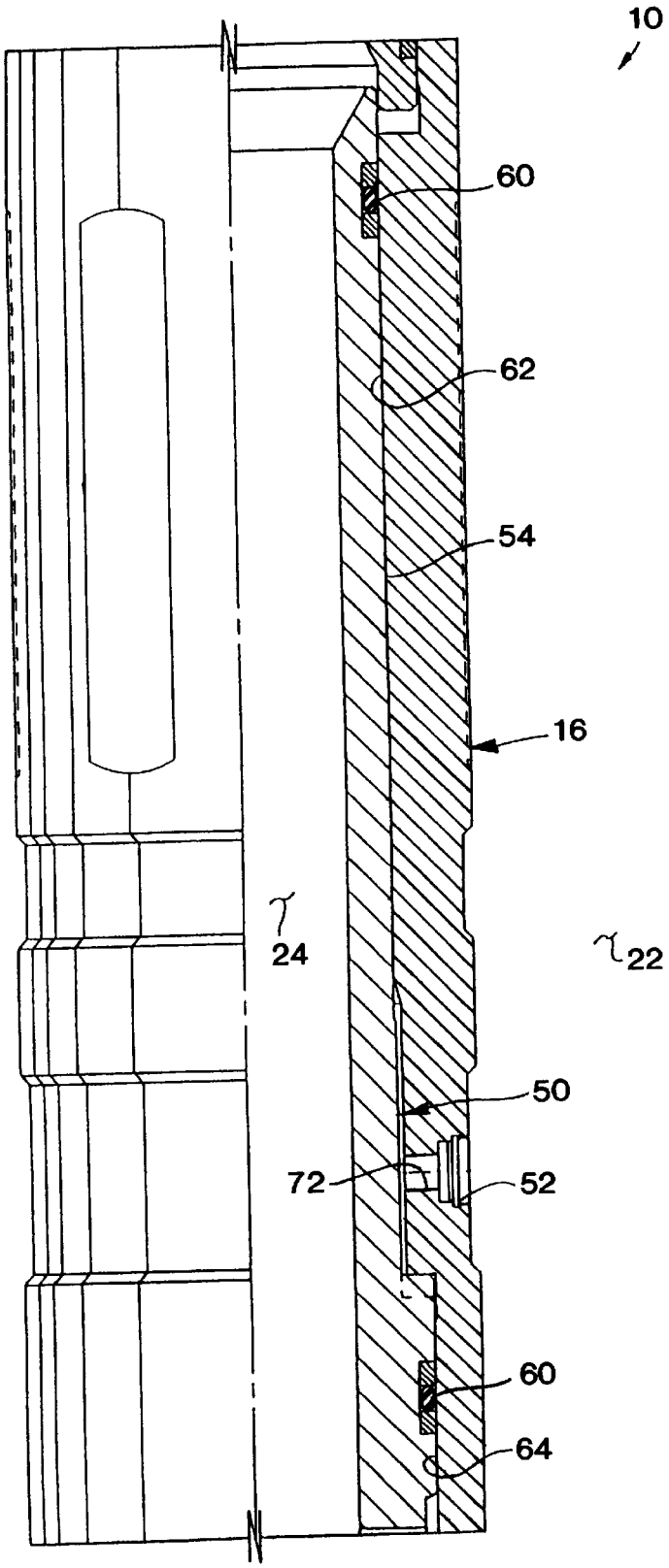
Figure 1C:
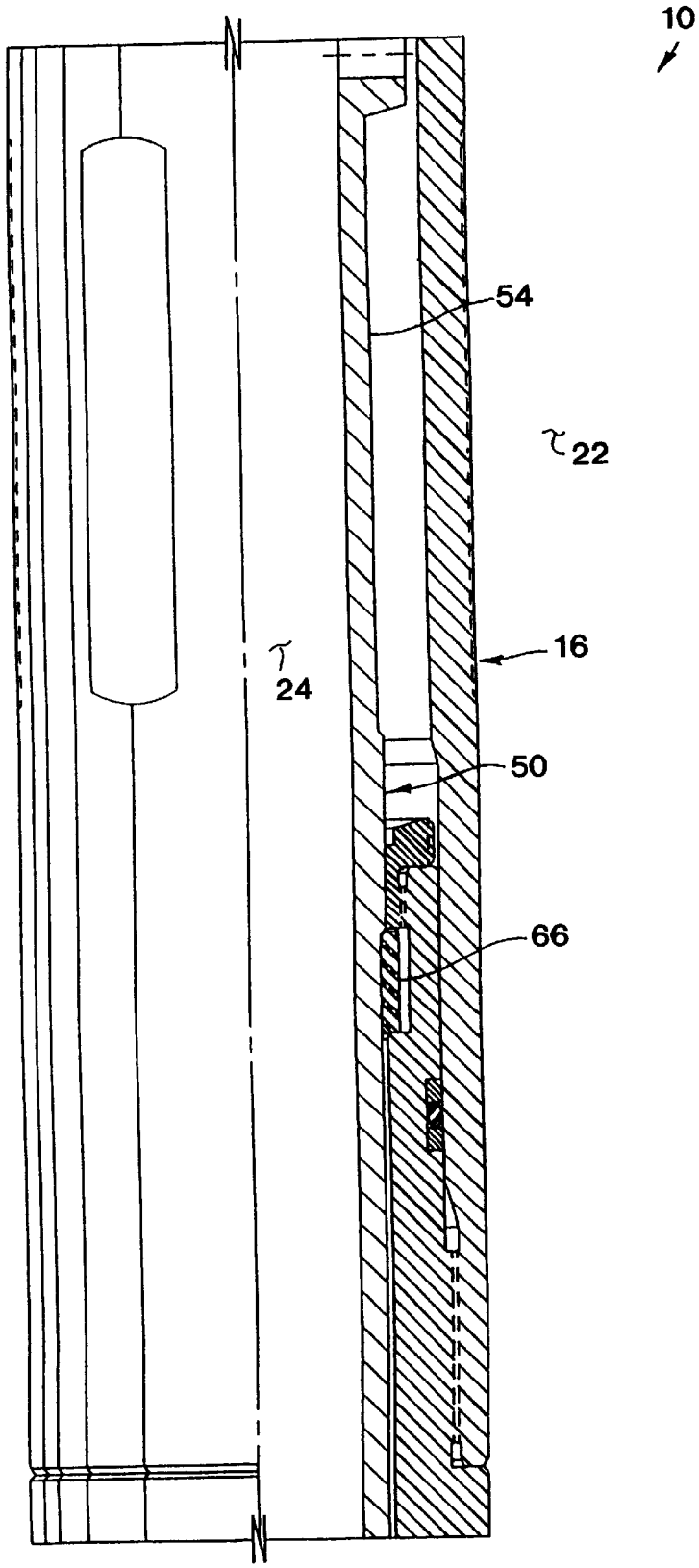
Figure 1D:
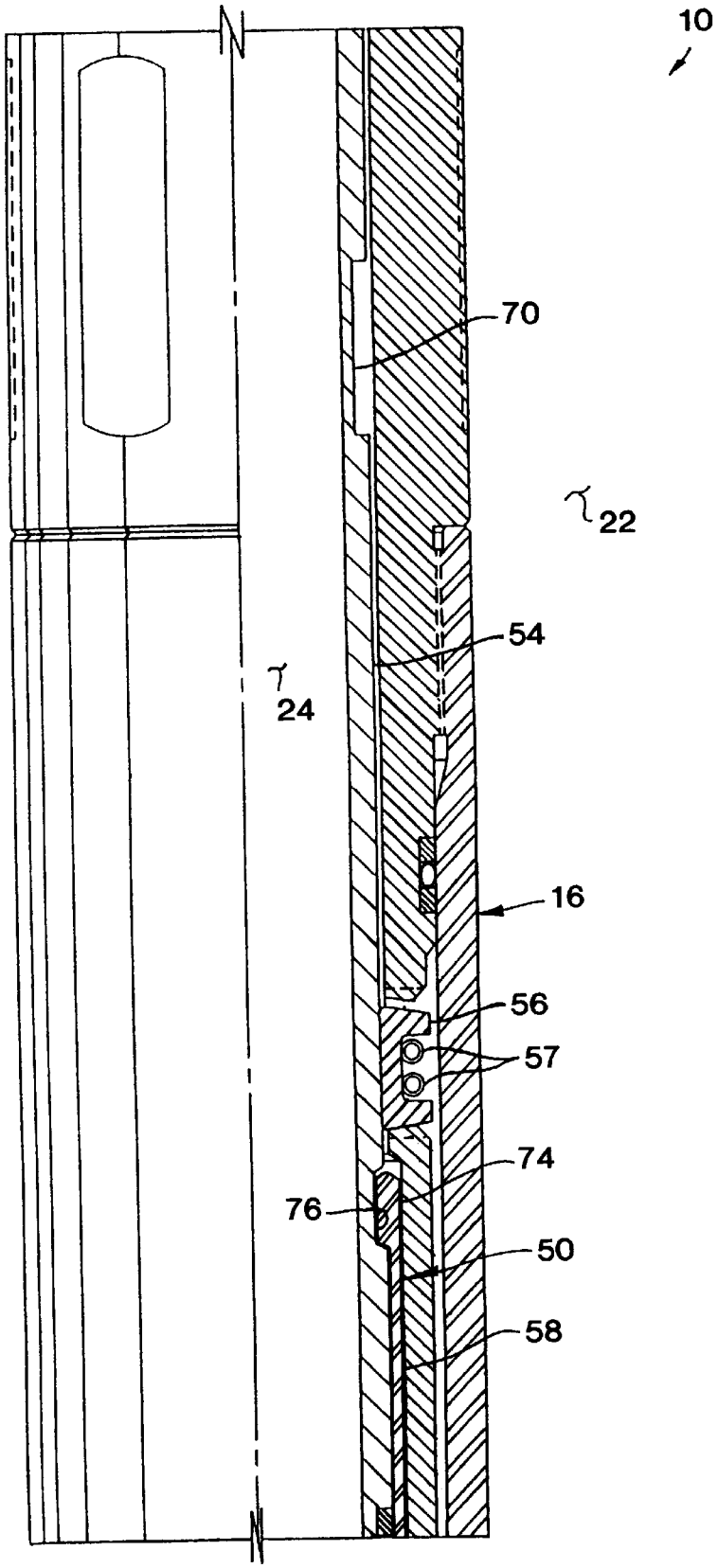

Representatively illustrated in FIGS. 1A–I is a valve assembly 10 which embodies principles of the present invention. In the following description of the valve assembly 10 and other apparatus and methods described herein, directional terms, such as "above", "below", "upper", "lower", etc., are used for convenience in referring to the accompanying drawings. Additionally, it is to be understood that the various embodiments of the present invention described herein may be utilized in various orientations, such as inclined, inverted, horizontal, vertical, etc., without departing from the principles of the present invention.

The valve assembly 10 depicted in FIGS. 1A–I includes a ball valve assembly 12 and a check valve assembly 14 contained within a generally tubular outer housing assembly 16. Upper and lower tubular threaded connector subs 18, 20 facilitate interconnection of the valve assembly 10 into a tubular string, such as a string of segmented tubing, drill pipe, coiled tubing, etc., in a conventional manner. The valve assembly 10 is shown in FIGS. 1A–I configured as it is run into a wellbore interconnected in a tubular string.

The ball valve 12 is closed as the tubular string is run into the well. This allows the integrity of the tubular string to be tested by periodically applying fluid pressure to the tubular string at the earth's surface. A leak in the tubular string may be detected by a pressure drop in the tubular string, or by a rise in fluid level or a pressure increase in an annulus 22 exterior to the housing assembly 16 and formed between the tubular string and the wellbore.

The check valve 14 opens when it senses a fluid pressure in the annulus 22 greater than fluid pressure in an internal axial flow bore 24 formed through the valve assembly 10. When this situation occurs, a tubular shuttle 26 is downwardly displaced against an upwardly biasing force exerted on the shuttle by a spring 28. Such downward displacement of the shuttle 26 permits fluid to flow from the annulus 22, inward through one or more ports 30 formed through the housing 16, inwardly through one or more ports 32 formed through tubular members within the housing, and into the flow bore 24 above the ball valve 12. Thus, as the valve assembly 10 is lowered into the wellbore, increasing hydrostatic pressure in the annulus 22 opens the check valve 14, allowing the tubular string to fill with fluid.

When the differential fluid pressure from the annulus 22 to the flow bore 24 is less than that required to overcome the biasing force of the spring 28 (or fluid pressure in the flow bore exceeds that in the annulus), the check valve 14 closes. The shuttle 26 is displaced upwardly by the spring 28, thereby closing off fluid flow between the ports 30, 32. The shuttle 26 may completely seal off flow between the ports 30, 32, or it may merely restrict fluid flow therebetween. Thus, when fluid pressure is applied to the flow bore 24 to pressure test the tubular string as described above, the check valve 14 prevents or restricts fluid flow from the flow bore to the annulus 22.

Fluid flow from the flow bore 24 to the annulus 22 is completely prevented when fluid pressure in the flow bore is greater than that in the annulus, due to downward displacement of the ball valve 12, check valve 14, and a force transmitting assembly or releasable lock 34 relative to the housing 16. The ball valve 12, check valve 14 and releasable lock 34 displace downward against an upwardly directed biasing force exerted on the ball valve by a spring 36. As shown in FIGS. 1A–I, the ball valve 12, check valve 14 and releasable lock 34 are in their upwardly disposed position relative to the housing 16, but it will be readily appreciated that, with the ball valve, check valve and releasable lock displaced downwardly, seals 38 carried on a tubular sleeve 40 will axially straddle and seal off the ports 30, and seals 42 carried on a tubular seat holder 44 and a tubular mandrel extension 46 of the ball valve will axially straddle and seal off ports 48 formed through the housing (see FIG. 4).

Therefore, the valve assembly 10 permits the tubular string to be filled with fluid automatically as it is lowered into the well, and permits the tubular string to be pressure tested periodically by applying fluid pressure to the tubular string. However, it is to be clearly understood that principles of the present invention may be incorporated in other types of valves, and in equipment other than valves.

The releasable lock 34 is interconnected to the ball valve 12 and is used to control operation of the ball valve by a force generating assembly 50. The ball valve 12 is operated by the force generating assembly 50 when sufficient fluid pressure is applied to the tubular string to seal off the ports 30, 48 as described above, and a greater fluid pressure is applied to the annulus 22 to rupture a rupture disk 52 and create a desired differential fluid pressure from the annulus to the flow bore 24.

The force generating assembly 50 includes the rupture disk 52, an annular piston 54, one or more locking dogs and a colleted sleeve 58. The piston 54 carries seals 60 thereon, which sealingly engage bores 62, 64 of the housing 16. The bores 62, 64 have different diameters, thereby forming a differential piston area therebetween. When fluid pressure in the annulus 22 greater than fluid pressure in the flow bore 24 is communicated to the differential piston area between the seals 60, the piston 54 is downwardly biased relative to the housing 16. A snap ring 66 engaged with a reduced outer diameter 68 of the piston 54 prevents downward displacement of the piston until a predetermined differential fluid pressure has been achieved.

When the predetermined differential fluid pressure has been applied from the annulus 22 to the flow bore 24, the snap ring 66 radially outwardly expands, permitting the piston 54 to displace downwardly. When the piston 54 has been displaced to its downwardly disposed position by the differential fluid pressure, the locking lugs 56 radially inwardly retract into an annular recess 70 formed externally on the piston, thereby preventing subsequent upward displacement of the piston relative to the housing 16 and preventing reclosure of the ball valve 12. The locking lugs 56 are radially inwardly biased by garter springs 57.

The rupture disk 52 is of conventional design. It ruptures and permits fluid communication between the annulus 22 and the piston 54 differential piston area via an opening 72 formed through the housing 16. Atmospheric pressure is trapped between the seals 60 before the rupture disk 52 ruptures, thus, the rupture disk ruptures when the pressure in the annulus 22 reaches a predetermined amount relative to atmospheric pressure, regardless the fluid pressure in the flow bore 24. However, note that fluid pressure greater than fluid pressure in the flow bore 24 is applied to the annulus 22 in order to displace the piston 54 downwardly relative to the housing 16. Therefore, it is not necessary for the fluid pressure in the annulus 22 to exceed the fluid pressure in the flow bore 24 at the time the rupture disk 52 is ruptured, but the piston 54 downwardly displaces in response to a positive differential fluid pressure from the annulus to the flow bore.

The sleeve 58 has axially extending and circumferentially spaced apart collets 74 formed on its upper end. The collets 74 are retained in an annular recess 76 formed externally on the piston 54. Such engagement of the collets 74 in the recess 76 causes the sleeve 58 to displace with the piston 54. Thus, when the piston 54 displaces downwardly, the sleeve 58 also displaces downwardly.

Downward displacement of the sleeve 58 causes the sleeve to axially contact the releasable lock 34. The releasable lock 34 includes a tubular releasing mandrel 78, a snap ring 80, one or more locking lugs 82, a connector sleeve 84, and a retainer sleeve 86. The locking lugs 82 prevent relative displacement between the sleeves 84, 86 as long as the lugs are engaged in an annular recess or profile 88 formed internally on the retainer sleeve 86. The lugs 82 are radially outwardly retained in engagement with the recess 88 by a radially enlarged portion 90 of the mandrel 78.

Figure 2:
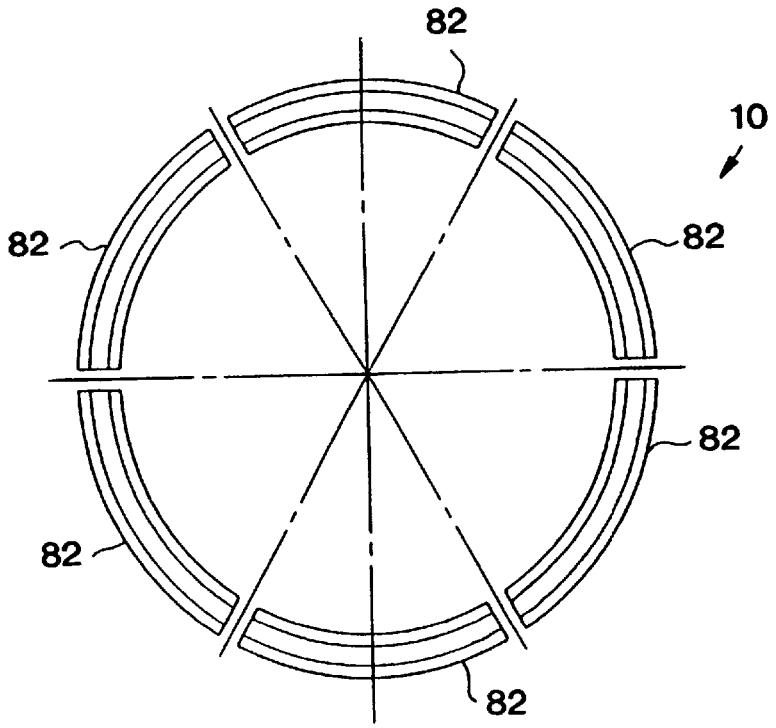
FIG. 2 is an enlarged scale top plan view of locking lugs of the valve assembly.

Referring additionally now to FIG. 2, six of the locking lugs 82 are shown from a top plan view thereof, apart from the remainder of the valve assembly 10. In this view, it may be clearly seen that each of the locking lugs 82 is a radial segment of a ring-shaped member. In the described embodiment, only two of the locking lugs 82 are utilized to prevent relative displacement between the sleeves 84, 86, but it is to be understood that other numbers of locking lugs, and other shapes and configurations of locking members, for example, balls, may be utilized, without departing from the principles of the present invention.

Figure 3:
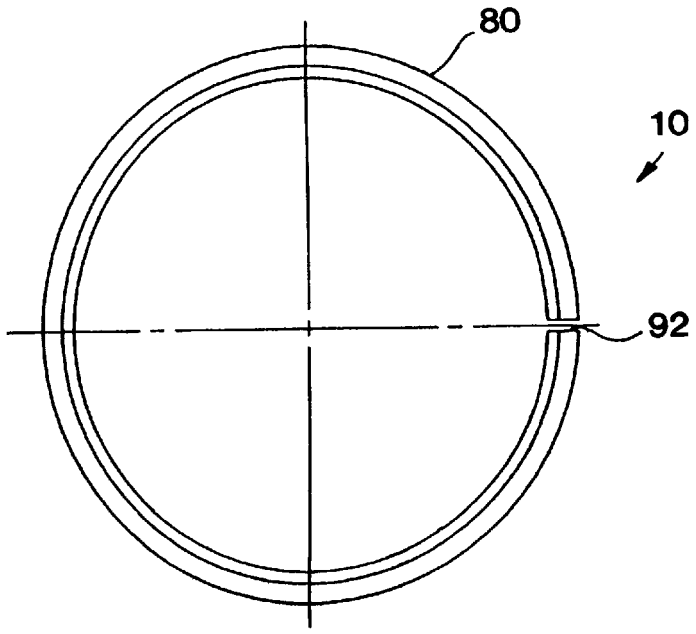
FIG. 3 is an enlarged scale top plan view of a snap ring of the valve assembly.

Referring additionally to FIG. 3, the snap ring 80 is shown from a top plan view thereof. The snap ring 80 is also formed from a ring-shaped member, but includes the entire member, except for a gap 92. The gap permits the snap ring 80 to radially expand and contract.

Figure 1E:
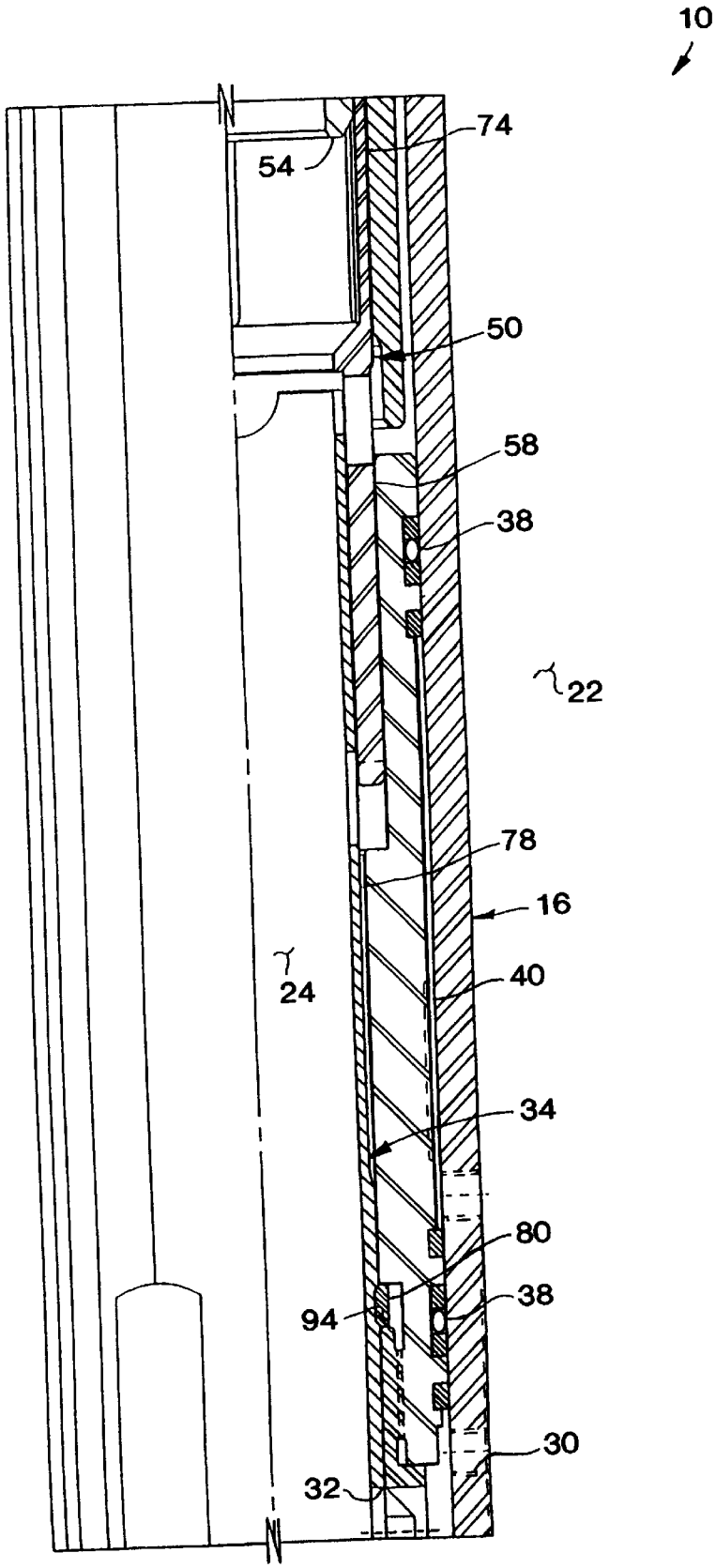
Figure 1F:
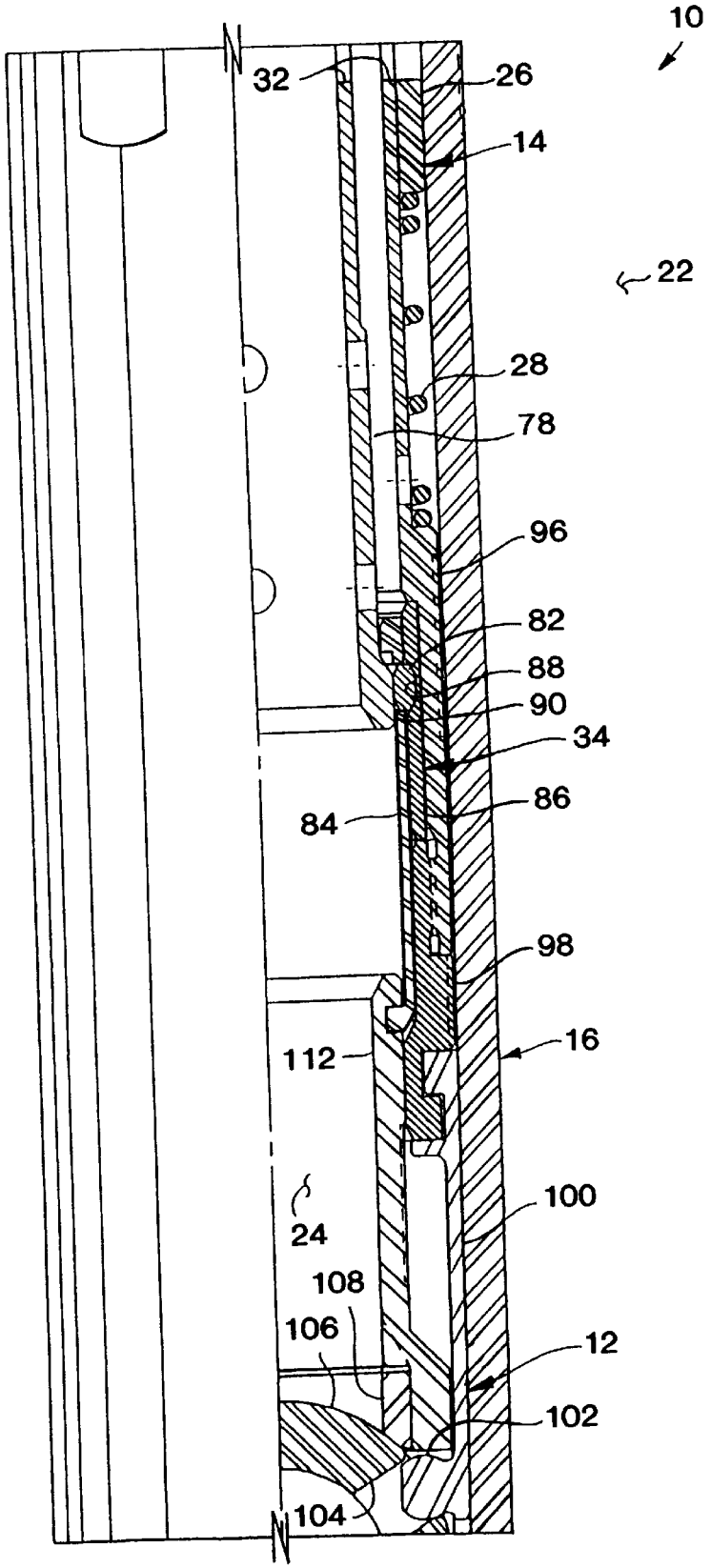
Figure 1G:
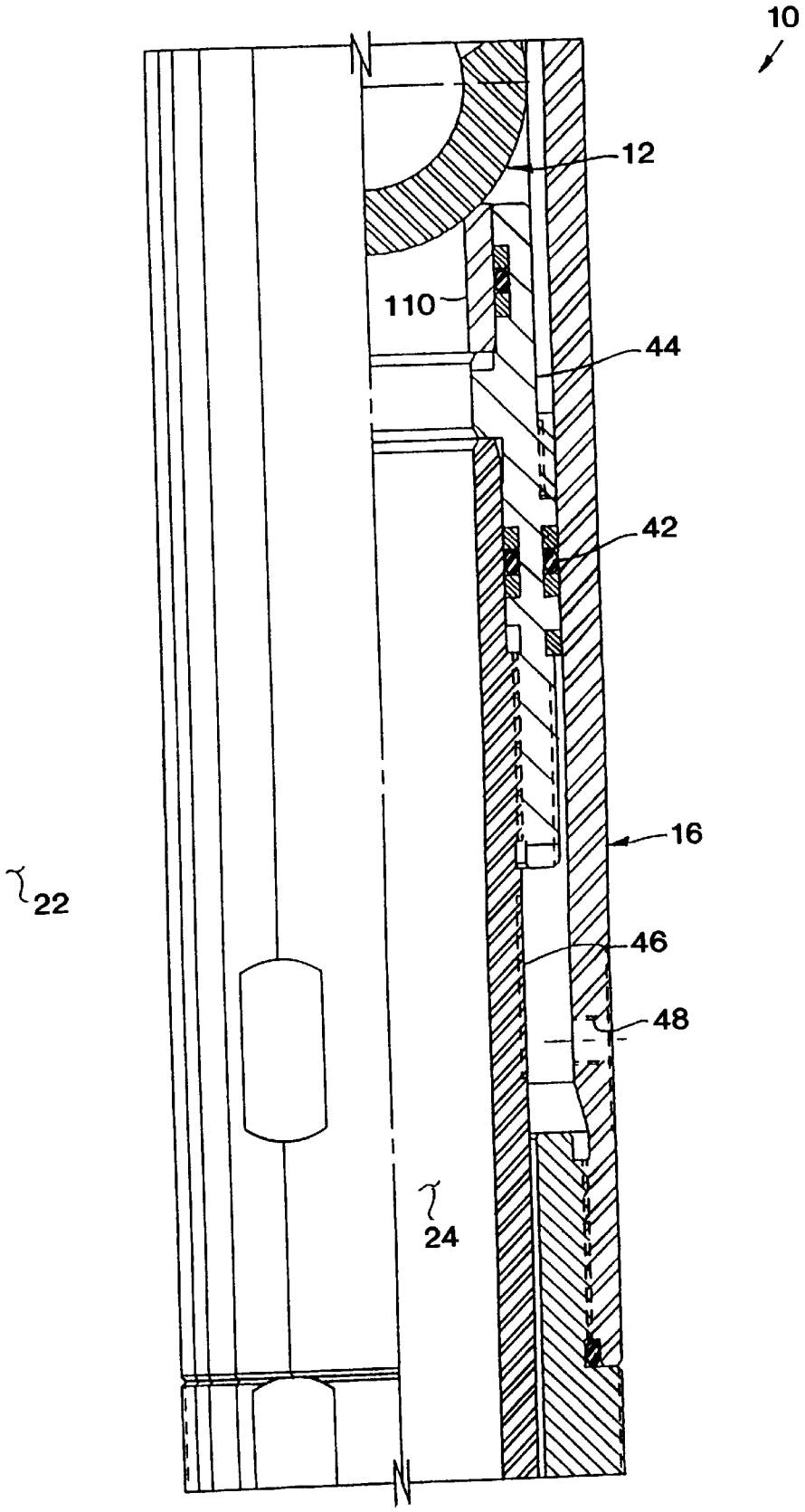
Figure 1H:
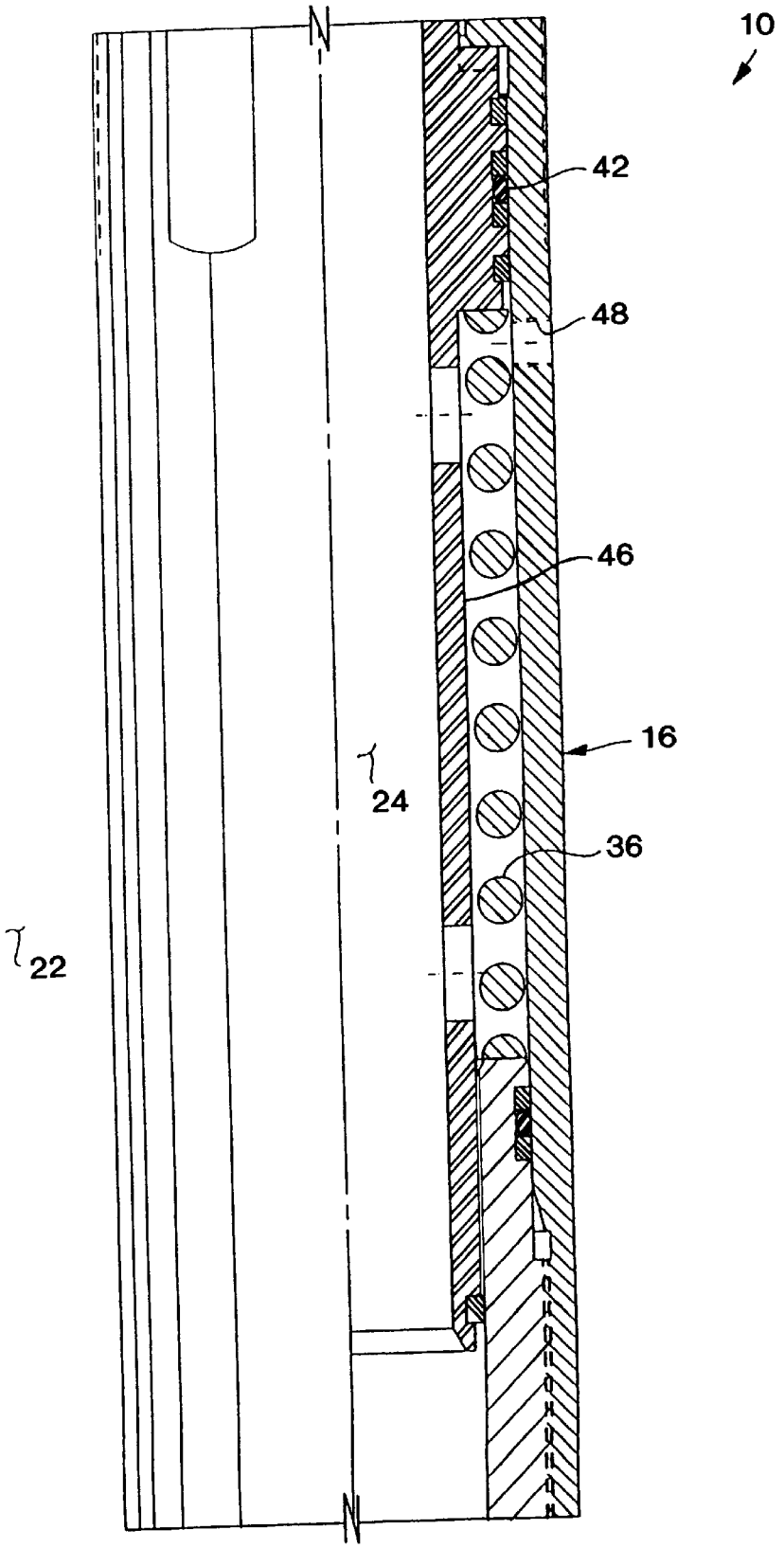
Figure 1I:
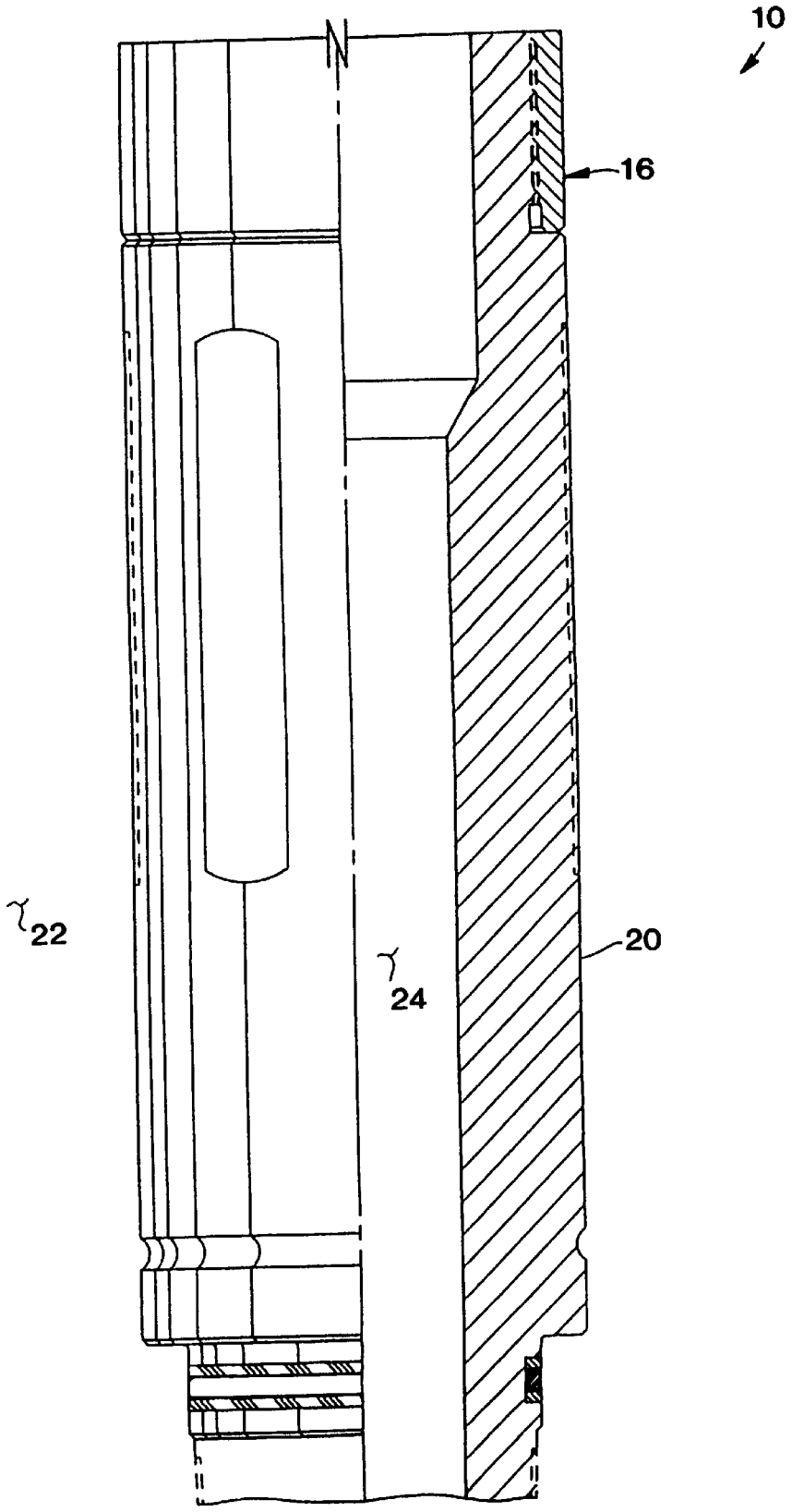

As shown in FIG. 1E, the snap ring 80 is engaged in an annular recess or profile 94 formed externally on the mandrel 78. However, when a predetermined axially downwardly-directed force is applied to the mandrel 78, the snap ring 80 is radially expanded out of engagement with the recess 94, thereby permitting the mandrel to displace downwardly.

Downward displacement of the mandrel 78 relative to the locking lugs 82 displaces the radially enlarged portion 90 away from its position radially outwardly supporting the lugs. Thus, the lugs 82 are permitted to displace radially inward and out of engagement with the recess 88. With the lugs 82 disengaged from the recess 88, the sleeves 84, 86 are permitted to displace relative to each other.

Note that the releasable lock 34 is interconnected to the ball valve 12 in a manner that prevents operation of the ball valve as long as the sleeves 84, 86 do not displace relative to each other. Therefore, until the mandrel 78 is displaced downwardly by the sleeve 58 of the force generating assembly 50, the releasable lock 34 prevents operation of the ball valve 12. The releasable lock 34 is released to permit operation of the ball valve 12 only by applying fluid pressure to the flow bore 24 greater than that in the annulus 22 to close off the ports 30,48, applying fluid pressure to the annulus to rupture the disk 52, and applying a differential fluid pressure from the annulus to the flow bore sufficiently great to downwardly displace the piston 54, the sleeve 58 and the mandrel 78.

With the releasable lock 34 released (that is, with the lugs 82 radially inwardly retracted out of engagement with the recess 88), the ball valve 12 may be opened by force transmitted through the releasable lock from the force generating assembly 50. The retainer sleeve 86 is axially retained between threadedly interconnected tubular members 96, 98. The lower one of these members 98 is connected to two opposing operator pin arms 100 (only one of which is visible in FIG. 1F) of the ball valve 12. Each of the arms 100 has a pin 102 formed internally thereon and engaged in a corresponding opening 104 formed through a ball 106 of the valve. When the arms 100 are downwardly displaced relative to the ball 106, the ball rotates, thereby opening the ball valve 12 and permitting fluid flow therethrough.

The ball 106 is retained between seats 108, 110. An upper tubular seat retainer 112 is connected to the sleeve 84. Thus, when the sleeve 86 is downwardly displaced relative to the sleeve 84, the operator pin arms 100 are displaced downwardly relative to the ball 106, seats 108, 110 and seat retainer 112, thereby opening the ball valve 12. This manner of operating a ball valve by displacing operator pin arms relative to a ball retained between seats is well known to those skilled in the art and will not be further described herein.

Downward displacement of the sleeve 86 relative to the sleeve 84 is accomplished by applying a downwardly directed force to the member 96 via the sleeve 40. After the sleeve 58 has contacted and downwardly displaced the mandrel 78, the sleeve 58 continues to downwardly displace and axially contacts the sleeve 40. Thus, the force generating assembly 50 applies a downwardly directed force to the operator pin arms 100 of the ball valve 12 via the sleeve 40, member 96 and member 98, after the releasable lock 34 has been released to permit relative displacement between the sleeves 84, 86.

Figure 4:
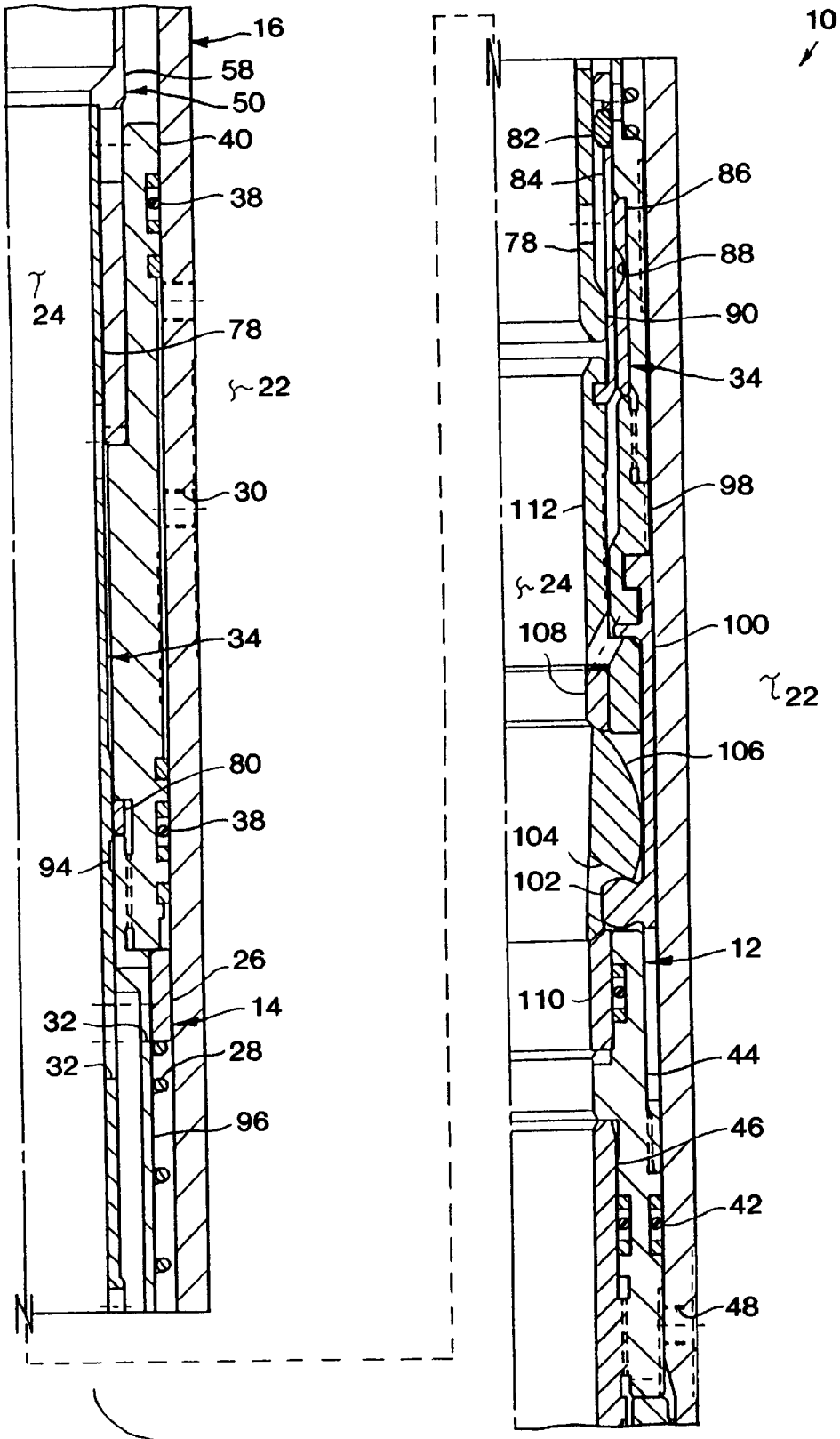
FIG. 4 is a quarter-sectional view of an axial portion of the valve assembly, the valve assembly being shown in a configuration in which a releasable lock embodying principles of the present invention is released.

Referring additionally now to FIG. 4, an anal portion of the valve assembly 10 is representatively illustrated. In this view, the valve assembly 10 is depicted after the ball valve 12 has been opened. Note that the sleeve 58 has contacted and downwardly displaced the release mandrel 78, and has contacted and downwardly displaced the sleeve 40.

Downward displacement of the mandrel 78 has permitted the lugs 82 to radially inwardly retract out of engagement with the recess 88, thereby releasing the releasable lock 34 and permitting relative displacement between the sleeves 84, 86. Downward displacement of the sleeve 40 has caused downward displacement of the operator pin arms 100, thereby opening the ball valve 12. Note that the ball valve 12 cannot be reclosed, due to the fact that, in this configuration, the locking dogs 56 have radially inwardly engaged the recess 70, preventing upward displacement of the piston 54 relative to the housing 16.

In the configuration representatively illustrated in FIG. 4, the valve assembly 10 prevents fluid communication between the annulus 22 and the flow bore 24, and permits fluid flow axially through the valve assembly, the flow bore extending through the ball 106. Further fluid pressures applied to the annulus 22 and/or flow bore 24 may cause some minimal displacements of elements of the valve assembly 10, but will not substantially change the valve assembly from the configuration shown in FIG. 4

Thus has been described the valve assembly 10 which includes the releasable lock 34. The releasable lock 34 accurately prevents operation of the ball valve 12 until a desired sequence of fluid pressures and differential fluid pressures have been applied to the valve assembly 10. Additionally, the releasable lock 34 is unaffected by pressure fluctuations, such as those due to pressure testing the tubular string as it is run into the well, and does not require the use of hydraulic chambers, special hydraulic fluids, etc.

Of course, many modifications, additions, substitutions, deletions and other changes may be made to the described embodiment of the invention, which changes would be obvious to those skilled in the art, and these are contemplated by the principles of the present invention. For example, the releasable lock 34 may be utilized to prevent closing of a valve until a desired condition has been achieved, may be utilized to otherwise control operation of another type of device, etc. Accordingly, the foregoing detailed description is to be clearly understood as being given by way of illustration and example only, the spirit and scope of the present invention being limited solely by the appended claims.

What is claimed is:

1. An apparatus operatively positionable in a subterranean well, the apparatus comprising:

a force transmitting assembly including first, second and third members releasably secured against displacement relative to each other, a force applied to the first member being transmitted to the second member when the third member is disposed in a first position, and relative displacement being permitted between the first and second members when the third member is disposed in a second position.

2. The apparatus according to claim 1, wherein the third member displaces relative to the second member between the first and second positions.

3. The apparatus according to claim 1, wherein the third member is releasably secured against displacement from the first to the second position.

4. The apparatus according to claim 3, wherein the third member is released for displacement from the first to the second position in response to fluid pressure applied to the apparatus.

5. The apparatus according to claim 3, wherein the third member is released for displacement from the first to the second position in response to fluid pressure applied to the exterior of the apparatus.

6. The apparatus according to claim 1, further comprising a force generating assembly, the force generating assembly displacing the third member from the first to the second position in response to fluid pressure applied to the apparatus.

7. The apparatus according to claim 6, wherein the force generating assembly displaces the third member only in response to a predetermined fluid pressure being applied to the apparatus.

8. The apparatus according to claim 6, wherein the force generating assembly displaces the first member relative to the second member in response to fluid pressure applied to the apparatus.

9. An apparatus operatively positionable in a subterranean wellbore, the apparatus comprising:

a force generating assembly operative to generate a force;

a device operating upon receipt of the force; and a force transmitting assembly selectively preventing and permitting transmission of the force to the device, the force transmitting assembly including first and second members slidingly disposed relative to each other, the first member being engageable with the force generating assembly, and the second member being engageable with the device.

10. The apparatus according to claim 9, wherein the force transmitting assembly permits transmission of the force to the device in response to application of fluid pressure to the apparatus.

11. The apparatus according to claim 10, wherein the force transmitting assembly permits transmission of the force in response to the fluid pressure applied to the exterior of the apparatus.

12. The apparatus according to claim 10, wherein the force transmitting assembly prevents transmission of the force to the device when the fluid pressure is applied only to an internal flow bore of the apparatus.

13. The apparatus according to claim 9, wherein the first member is releasably secured against displacement relative to the second member by a securement member.

14. The apparatus according to claim 13, wherein the securement member is a lug secured against displacement relative to the second member, the lug being received in a profile formed on the first member.

15. Apparatus operatively positionable in a subterranean well, the apparatus comprising:

a ball valve operable upon receipt of a force applied thereto;

a force generating assembly operable to generate the force; and a force transmitting assembly interconnected between the ball valve and the force generating assembly, the force transmitting assembly transmitting the force from the force generating assembly to the ball valve in response to displacement of a first member relative to a second member of the force transmitting assembly, and the first member displacing relative to the second member in response to a predetermined fluid pressure applied to the apparatus.

16. The apparatus according to claim 15, wherein the force generating assembly includes a piston having a differential piston area exposed to fluid pressure exterior to the apparatus.

17. The apparatus according to claim 16, wherein the piston applies the force to the first member when the predetermined fluid pressure is applied to the exterior of the apparatus.

18. The apparatus according to claim 16, wherein the force transmitting assembly includes a mandrel displaceable relative to the first and second members and selectively positionable in a first position in which relative displacement between the first and second members is prevented, and a second position in which relative displacement between the first and second members is permitted.

19. The apparatus according to claim 18, wherein the mandrel is releasably secured in the first position, the mandrel displacing to the second position when the predetermined fluid pressure is applied to the apparatus.

20. The apparatus according to claim 19, wherein the mandrel is releasably secured in the first position by a snap ring, the snap ring permitting displacement of the mandrel when the force is applied to the mandrel.

* * * * *